US006298609B1

(12) United States Patent
Bifano et al.

(10) Patent No.: US 6,298,609 B1
(45) Date of Patent: Oct. 9, 2001

(54) CONSTRUCTION SYSTEM WITH PANEL SUPPORT ACCESSORY

(75) Inventors: Gabriel F. Bifano, Miami; Erenio Reyes, Miramar, both of FL (US)

(73) Assignee: Vinyl Corp., Miami, FL (US)

( * ) Notice: Subject to any disclaimer, the term of this patent is extended or adjusted under 35 U.S.C. 154(b) by 0 days.

(21) Appl. No.: 09/558,761

(22) Filed: Apr. 21, 2000

Related U.S. Application Data

(63) Continuation-in-part of application No. 09/305,631, filed on May 5, 1999, now Pat. No. 6,119,429, which is a continuation of application No. 09/059,743, filed on Apr. 14, 1998, now Pat. No. 5,946,870.

(51) Int. Cl.[7] ..... E04B 1/00
(52) U.S. Cl. ..... 52/58; 52/101; 52/209; 52/254; 52/443; 52/302.3
(58) Field of Search ..... 52/58, 60, 62, 52/254, 443, 446, 302.1, 302.3, 302.6, 293.1, 293.3, 265, 267, 209, 101, 479, 781.3, 734.1; 428/598, 603

(56) References Cited

U.S. PATENT DOCUMENTS

| | | | |
|---|---|---|---|
| 1,310,331 | | 7/1919 | Ficklen . |
| 2,073,185 | | 3/1937 | Shafer . |
| 2,483,888 | | 10/1949 | Danielson . |
| 2,645,824 | | 7/1953 | Titsworth . |
| 2,703,002 | | 3/1955 | Suskind . |
| 2,822,761 | * | 2/1958 | Herring ..... 52/61 |
| 2,905,072 | | 9/1959 | Oswald . |
| 3,019,866 | | 2/1962 | Grabowski . |
| 3,239,977 | | 3/1966 | Shore . |
| 3,314,201 | | 4/1967 | Riegelman . |
| 3,332,180 | | 7/1967 | Price . |
| 3,471,982 | | 10/1969 | Strozewski . |
| 3,485,001 | | 12/1969 | Miller . |
| 3,494,085 | | 2/1970 | Van Bael . |
| 3,509,674 | | 5/1970 | Birum, Jr. . |
| 3,568,391 | | 3/1971 | Conway . |

(List continued on next page.)

OTHER PUBLICATIONS

"Vinyl Corp. Product Data" Catalog; copyright 1997.
"VinylTech Plastic Components, Inc."; Excerpts from Catalog; 8 pages.
State of Georgia Specification.
United States Gypsum Company, USG Exterior, Products & Systems.

*Primary Examiner*—Carl D. Friedman
*Assistant Examiner*—Brian E. Glessner
(74) *Attorney, Agent, or Firm*—Foley & Lardner

(57) ABSTRACT

A construction system including a panel support accessory is disclosed. In addition to the panel support construction accessory, the construction system includes at least one structural support member, a construction panel and a coating. The panel support construction accessory includes a front flange having a first side and a second opposite side, a bottom flange extending from the front flange on the first side of the front flange and a back flange extending from the bottom flange opposite the front flange. The front flange, the bottom flange and the back flange form a channel. The back flange is supported by the at least one structural support member. The panel support construction accessory additional includes a forward flange extending from a junction of the front flange and the bottom flange on the second side of the front flange. The construction panel is positioned within the channel and the coating extends from the forward flange adjacent to the second side of the front flange and adjacent to the construction panel. In one embodiment, the construction system additionally includes a rear flange extending from the front flange towards the back flange above the bottom flange. In one exemplary embodiment, the bottom flange includes a plurality of perforations extending therethrough and the accessory additionally includes a lower flange spaced from the bottom flange to form a cavity below the plurality of perforations. The forward flange extends below the cavity to at least partially conceal the cavity.

47 Claims, 6 Drawing Sheets

U.S. PATENT DOCUMENTS

| | | | | |
|---|---|---|---|---|
| 3,638,372 | | 2/1972 | Rosenthal . | |
| 3,922,826 | * | 12/1975 | Molyneux | 52/204.1 |
| 4,059,936 | | 11/1977 | Lukens . | |
| 4,075,800 | | 2/1978 | Molick . | |
| 4,110,942 | * | 9/1978 | Slocomb, Jr. . | |
| 4,621,470 | | 11/1986 | Balinski . | |
| 4,622,791 | | 11/1986 | Cook et al. . | |
| 4,624,087 | | 11/1986 | Schneller . | |
| 4,691,487 | | 9/1987 | Kessler . | |
| 4,722,153 | | 2/1988 | Hardy . | |
| 4,752,517 | | 6/1988 | Beitel . | |
| 4,936,069 | | 6/1990 | Hunter et al. . | |
| 4,947,593 | | 8/1990 | Kuo . | |
| 4,984,402 | | 1/1991 | Davies . | |
| 5,003,743 | | 4/1991 | Bifano et al. . | |
| 5,022,212 | | 6/1991 | Lippolt . | |
| 5,226,274 | | 7/1993 | Somerstein . | |
| 5,272,846 | | 12/1993 | Kelley et al. . | |
| 5,397,201 | | 3/1995 | Novak et al. . | |
| 5,414,965 | | 5/1995 | Kelley et al. . | |
| 5,433,986 | | 7/1995 | Moscatello . | |
| 5,519,969 | | 5/1996 | Golba . | |
| 5,531,050 | | 7/1996 | Stibolt et al. . | |
| 5,671,571 | * | 9/1997 | Braun | 52/211 |
| 5,718,086 | | 2/1998 | Dunn . | |
| 5,729,939 | | 3/1998 | Di Benedetto . | |
| 5,784,838 | | 7/1998 | Phillips . | |
| 5,836,135 | | 11/1998 | Hagan et al. . | |
| 5,918,427 | | 7/1999 | VanderWerf . | |
| 5,937,600 | * | 8/1999 | Larson | 52/302.6 |
| 6,108,991 | * | 8/2000 | Hagen et al. | 52/302.3 |

* cited by examiner

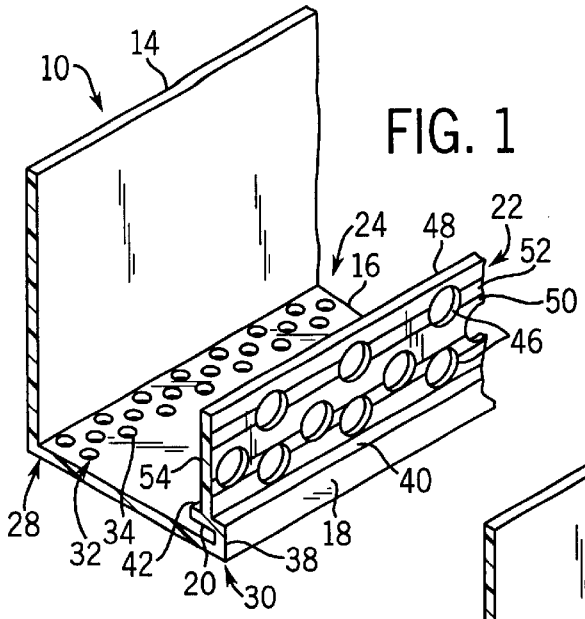
FIG. 1
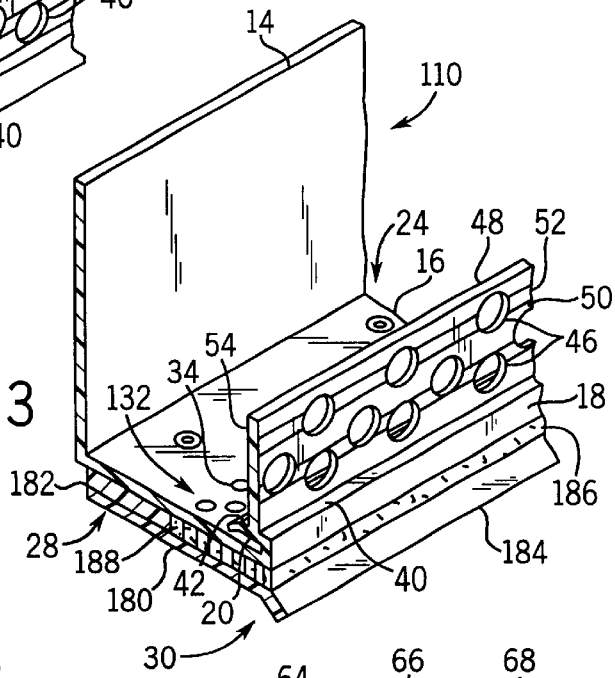
FIG. 3
FIG. 2
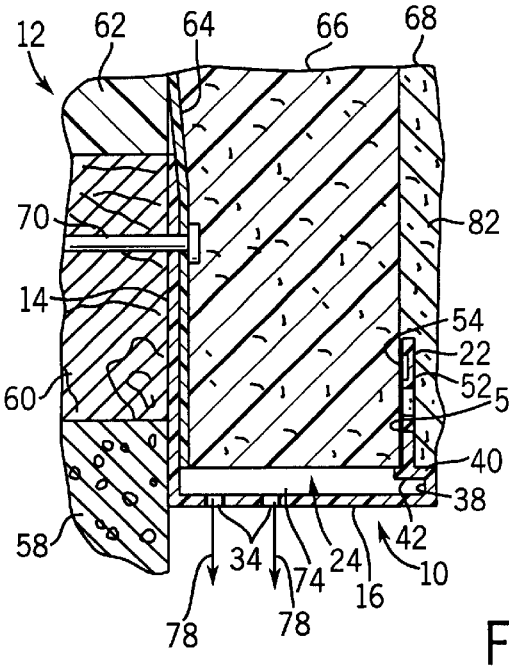
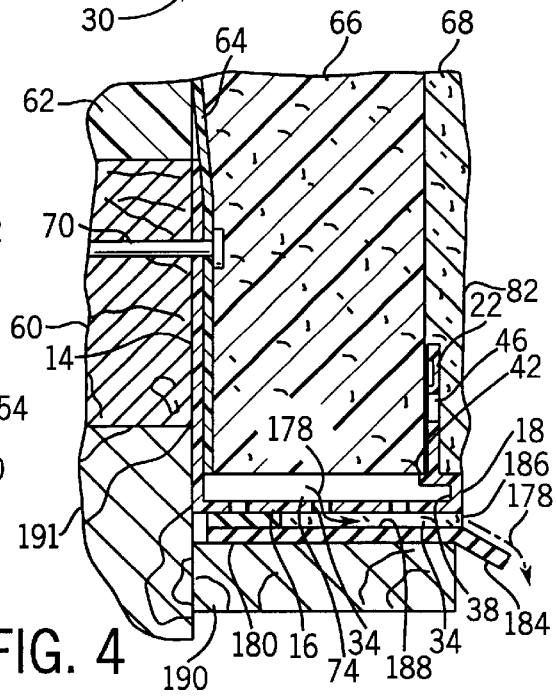
FIG. 4

CONSTRUCTION SYSTEM WITH PANEL SUPPORT ACCESSORY

CROSS REFERENCE TO RELATED APPLICATIONS

The present application is a continuation-in-part of U.S. patent application Ser. No. 09/305,631 entitled PANEL SUPPORT CONSTRUCTION ACCESSORY filed on May 5, 1999 (from which priority is claimed under 35 U.S.C. § 120), now U.S. Pat. No. 6,119,429, which is a continuation of U.S. Pat. No. 5,946,870, filed as U.S. patent application Ser. No. 09/059,943, on Apr. 14, 1998, and issued on Sep. 7, 1999, the full disclosures of which are hereby incorporated by reference. The present application is also related to U.S. patent application Ser. No. 09/059,806, entitled CONSTRUCTION ACCESSORY, filed on Apr. 14, 1998, now U.S. Pat. No. 5,970,671, the full disclosure of which is hereby incorporated by reference.

FIELD OF THE INVENTION

The present invention relates to construction accessories. In particular, the present invention relates to a panel support construction accessory utilized in a wall structure, wherein a panel support construction accessory partially encloses a construction panel and removes moisture from about the construction panel.

BACKGROUND OF THE INVENTION

Panel support construction accessories come in a variety of different configurations, shapes and sizes, and serve a variety of different functions in exterior construction applications. Panel support construction accessories generally include a plurality of flanges extending nonparallel relative to one another to form a channel sized to receive a construction panel. Panel support construction accessories have various uses, such as supporting panels, supporting coatings of construction fluid materials adjacent the panels, producing durable straight lines, smooth curves and arches, providing soffit ventilation, controlling expansion and contraction and protecting corners and edges. Panel support construction assemblies further protect and preserve edges of construction panels, such as wallboard, sheathing, and insulation boards from impact and condensation. Panel support construction accessories are commonly known by various names, including but not limited to, corner beads, casing beads, starter strip/casing beads, reinforced, drip casing beads, controlled joints and soffit vents. Panel support construction accessories are used in exterior finishing systems known as direct exterior finishing systems (DEFS) and exterior insulated finishing systems (EIFS).

Panel support construction accessories are typically supported adjacent a support structure lined with a moisture barrier. After a construction panel is inserted into the channel of the panel support construction accessory, the front of the accessory as well as the front of the construction panel are typically coated with a polymer based or polymer modified exterior construction fluid material, such as stucco, cement matrix material or gypsum matrix materials, including acrylic modifiers, or are lined with a preformed sheet of weatherproof material. As a result, the panel support construction accessory, moisture barrier and the outer coating, or sheet of weatherproof material, form an enclosure partially surrounding and encasing the construction panel. In addition to encasing the construction panel, the enclosure traps moisture adjacent to the construction panel. Unless perfectly sealed, additional moisture may enter the system through various cracks or openings. Moisture trapped within the enclosure and condenses to damage the construction panel. In addition, trapped moisture may change state from a liquid to a solid (ice) and expand in volume. This change in volume further damages the enclosure by causing the coating to crack or by causing deformation of the panel support construction accessory. As a result, it is critical that moisture within the enclosure be allowed to escape. At the same time, however, it is also critical that any methods used to vent moisture from the enclosure not enable wind-blown moisture to re-enter the enclosure or allow insects, such as flying termites, to enter the enclosure.

SUMMARY OF THE INVENTION

The present invention is directed to a construction system. The construction system includes at least one structural support member, a panel support construction accessory, a construction panel and a coating. The construction accessory includes a front flange having a first side and a second opposite side, a bottom flange extending from the front flange on the first side of the front flange, a back flange extending from the bottom flange opposite the front flange, and a forward flange extending from a junction of the front flange and the bottom flange on the second side of the front flange. The front flange, the bottom flange and the back flange form a channel in which the construction panel is positioned. The back flange is supported by the at least one structural support member. The coating extends from the forward flange adjacent to the second side of the front flange and adjacent to the construction panel.

The present invention is also directed to a panel support construction accessory. The accessory includes a front flange having a first side and a second opposite side, a bottom flange extending from the front flange on the first side of the front flange, a back flange extending from the bottom flange opposite the front flange, a plurality of perforations extending through the bottom flange, a lower flange facing the bottom flange and spaced from the bottom flange to form a cavity below the plurality of perforations, and a forward flange extending from above the cavity to below the cavity in front of the cavity to at least partially conceal the cavity. The front flange, the bottom flange and the back flange form a channel sized to receive a construction panel.

The present invention is also directed to a panel support construction accessory including a front flange having a first side and a second opposite side, a bottom flange extending from the front flange on the first side of the front flange, a back flange extending from the bottom flange opposite the front flange, a forward flange extending from a junction of the front flange and the bottom flange on the second side of the front flange and a rear flange extending from the front flange towards the back flange above the bottom flange. The front flange, the bottom flange and the back flange form a channel sized to receive a construction panel.

The present invention is also directed to a panel support construction accessory which includes a front flange having a first side and a second opposite side, a bottom flange extending from the front flange on the first side of the front flange, a back flange extending from the bottom flange opposite the front flange, a forward flange extending from a junction of the front flange and the bottom flange on the second side of the front flange, and a rear flange extending from the front flange towards the back flange above the bottom flange. The front flange, the bottom flange and the back flange form a channel sized to receive a construction panel.

The present invention is also directed to a panel support construction accessory including a bottom flange having a first side, a second side and a plurality of perforations extending therethrough from the first side to the second side; a lower flange extending below the bottom flange; at least one mounting flange coupled to at least one of the bottom flange and the lower flange and configured to mount the panel support construction accessory to a structure and at least one channel-forming flange extending above the bottom flange opposite the at least one mounting flange. At least a portion of the lower flange is spaced from the bottom flange to form a cavity therebetween. The accessory additionally includes at least one concealment flange extending from above the cavity to below the cavity to conceal the cavity.

The present invention also provides a panel support construction accessory which includes a bottom flange having a first side, a second side and a plurality of perforations extending therethrough from the first side to the second side; a back flange extending from the bottom flange on the first side of the bottom flange; a front flange extending from the bottom flange on the first side of the bottom flange; and a rear flange extending from the front flange towards the back flange. The front flange extends in a single plane. The rear flange is spaced from the bottom flange on the first side of the bottom flange.

BRIEF DESCRIPTION OF THE DRAWINGS

FIG. 1 is a perspective view of an exemplary panel support construction accessory of the present invention.

FIG. 2 is a sectional view of a structure incorporating the panel support construction accessory of FIG. 1.

FIG. 3 is a perspective view of a second embodiment of the panel support construction accessory of FIGS. 1 and 2.

FIG. 4 is a sectional view of a structure incorporating the panel support construction accessory of FIG. 3.

DETAILED DESCRIPTION OF THE PREFERRED EMBODIMENTS

Figure 5:
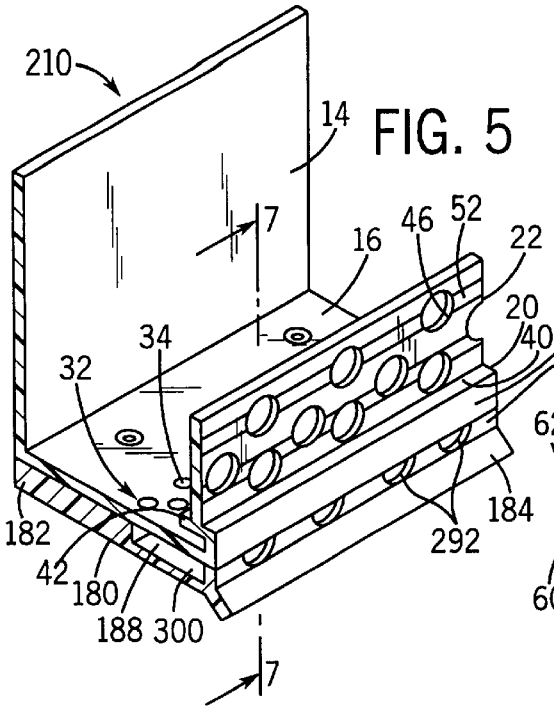
FIG. 5 is a perspective view of a third embodiment of the panel support construction accessory of FIGS. 1 and 2.

FIGS. 1 and 2 illustrate panel support construction accessory 10. FIG. 1 is a perspective view of panel support construction accessory 10. FIG. 2 is a sectional view of panel support construction accessory 10 utilized in a structure 12. As best shown by FIG. 1, construction accessory 10 generally includes back flange 14, bottom flange 16, side flange 18, support flange 20 and front flange 22. Back flange 14, bottom flange 16, side flange 18, support flange 20, and front flange 22 nonparallel extend relative to one another to form an axially extending channel 24 sized to receive and support a construction panel adjacent structural members. Back flange 14 is a generally elongate panel configured for being mounted adjacent to a structural support member of a structure.

Bottom flange 16 comprises an elongate, panel coupled to back flange 14 and extending nonparallel from back flange 14. Bottom flange 16 preferably extends nonparallel from back flange 14 at an angle of about ninety degrees. Bottom flange 16 has a first edge 28 coupled to back flange 14 and a second opposite edge 30 coupled to side flange 18. Bottom flange 16 includes an array 32 of perforations 34 extending through bottom flange 16. Perforations 34 generally comprise apertures or openings extending through bottom flange 16 and sized for transmitting moisture from within channel 24. Perforations 34 are configured into an elongate array 32 axially extending along the length of accessory 10 adjacent back flange 14. Array 32 preferably comprises three rows of perforations 34 such that multiple perforations 34 colinearly extend between edges 28 and 30 of bottom flange 16. It has been discovered that array 32 of perforations 34 effectively eliminates moisture from within channel 24. Because array 32 extends along edge 28 of bottom flange 16 adjacent back flange 14, rain and other wind-blown moisture is less likely to be blown through perforations 34 into channel 24. Because perforations 34 have a maximum diameter of approximately one-eighth of an inch, perforations 34 further prevent wind-blown moisture from entering through perforations 34 and further prevent winged insects, such as winged termites, from entering channel 24 through perforations 34. Moreover, because perforations 34 are arranged in an array 32 having a plurality of perforation rows axially extending along bottom flange 16 and having multiple perforations 34 colinearly extending between edge 28 and edge 30 of bottom flange 16, perforations 34 more effectively transmit moisture out of channel 24. In addition, because bottom flange 16 includes an array 32 of perforations 34, accidental blockage of every perforation 34, such as by painting, is generally eliminated.

Side flange 18, support flange 20 and front flange 22 are described and illustrated in co-pending patent application U.S. patent application Ser. No. 09/059,806 now U.S. Pat. No. 5,970,671 by Gabriel F. Bifano and Erenio Reyes entitled "CONSTRUCTION ACCESSORY" filed on the same date herewith (hereby incorporated by reference). As shown by FIG. 1, side flange 18 and support flange 20 form a channel 38 sized to receive a reinforcement member such as a splice (not shown) for connecting adjacent accessories 10. Support flange 20 further forms shoulder 40 and ridge 42, the functions of which are illustrated in FIG. 2. Front flange 22 extends nonparallel from support flange 20 between shoulder 40 and ridge 42. Front flange 22 includes perforations 46 which extend between an inner surface 48 and an outer surface 50 of front flange 22. Front flange 22 further includes depressions 52, 54. Depressions 52, 54 comprise elongate channels formed within outer surface 50 and inner surface 48, respectively, of front flange 22. Depressions 52, 54 extend along the axial length of front flange 22 and communicate between perforations 46 to increase the flow of construction fluid materials along front flange 22.

FIG. 2 illustrates panel support construction accessory 10 incorporated into structure 12. As shown by FIG. 2, structure 12 additionally includes foundation 58, structural support members 60, 62, moisture barrier 64, construction panel 66, coating 68 and fastener 70. Foundation 58 and structural support member 60 and 62 form a conventionally known structural arrangement wherein structural support member 60 comprises a base two-by-four and structural support member 62 comprises a stud two-by-four fastened to member 62. As shown by FIG. 2, accessory 10 is fastened to structural support member 60 by fastener 70. To prevent moisture from entering a building or other enclosure formed by structure 12, moisture barrier 64 is positioned within channel 24 over back flange 14 and adjacent structural support members 60 and 62. As can be appreciated, back flange 14 of accessory 10 may be affixed to either structure support member 60 or 62 by various other adhesives or fasteners. Moreover, back flange 14 may alternatively be affixed on intermediate sheet or panel affixed to structural support members 60 and 62.

Construction panel 66 extends within channel 24 of accessory 10. As shown by FIG. 4, ridge 42 elevates construction panel 66 above bottom flange 16 to form a gap or space 74 between bottom flange 16 and construction panel 66. Space 74 allows moisture accumulation and facilitates the discharge of moisture from between moisture barrier 64 and coating 68 through perforations 34 as indicated by arrows 78.

Shoulder 40 supports coating 68 adjacent front flange 22 and adjacent construction panel 66. As a result, coating 68 forms a frontal surface 82 which is contiguous with a front surface of side flange 18. Consequently, side flange 18 and bottom flange 16 also provide a smooth and impact resistant corner to the front face of structure 12. This corner as well as the front surfaces of side flange 18 and coating 68 may be painted, further finished or left in a natural state. Construction accessory 10 is preferably extruded from a vinyl compound. Construction accessory 10 is preferably extruded from a weatherable exterior grade polyvinylchloride. Construction accessory 10 alternatively may be formed from various other polymer or vinyl compounds, aluminum, galvanized steel or other metals. Moreover, in lieu of being integrally formed as part of a single unitary body, construction accessory 10 may be formed using various distinct prefabricated components, which are glued, welded or otherwise affixed to one another to form construction accessory 10. Back flange 14, bottom flange 16, side flange 18, support flange 20 and front flange 22 preferably have a thickness of about 1/16th of an inch. As can be appreciated, the thickness of each of flanges 14, 16, 18, 20 and 22 will independently vary depending upon construction application. Perforations 46 preferably have a diameter of about 0.25 inches and are drilled or punched into front flange 22. Depressions 52 and 54 are preferably extruded with front flange 22. Alternatively, perforations 46 as well as depressions 52 and 54 may be formed by various other manufacturing techniques.

FIGS. 3 and 4 illustrate panel support construction accessory 110, a second embodiment of panel support construction accessory 10 shown in FIGS. 1 and 2. As shown in FIG. 3, panel support construction accessory 110 includes array 132 of perforations 34 in lieu of array 32 of perforations 34. Accessory 110 additionally includes lower flange 180, spacer 182, drip leg 184 and filter material 186. For ease of illustration, those elements of accessory 110 which substantially correspond to similar elements of accessory 10 are numbered similarly. Array 132 is similar to array 32 except that array 132 extends proximate to edge 30 of bottom flange 16 axially along accessory 110. In particular, array 132 of perforations 34 is transversely located between ridge 42 and spacer 182. As with array 32, array 132 of perforations 34 comprises three rows of perforations 34 such that multiple perforations 34 colinearly extend between edges 28 and 30 of bottom flange 16. It has been discovered that array 32 of perforations 34 effectively eliminates moisture from within channel 24. Because perforations 34 have a maximum diameter of approximately one-eighth of an inch, perforations 34 further prevent wind-blown moisture from entering through perforations 34 and further prevent winged insects, such as winged termites, from entering channel 24 through perforations 34. Moreover, because perforations 34 are arranged in an array 32 having a plurality of perforation rows axially extending along bottom flange 16 having multiple perforations 34 colinearly extending between edge 28 and edge 30 of bottom flange 16, perforations 34 more effectively transmit moisture out of channel 24.

Lower flange 180 is a generally elongate imperforate panel coupled to bottom flange 16 and spaced from bottom flange 16 to form a cavity 188 adjacent to and below array 132 of perforations 34. In the preferred embodiment illustrated, lower flange 180 is spaced from bottom flange 16 by approximately 1/32 to 1/4 of an inch. In the embodiment illustrated, lower flange 180 is spaced from bottom flange by 1/16 of an inch. Lower flange 180 prevents wind-blown moisture from entering channel 24 through perforations 34. Lower flange 180 also impedes flying insects from entering channel 24 through perforations 34. At the same time, lower flange 180 directs moisture expelled from channel 24 through perforations 34 outward towards leg 184. Lower flange 180 is preferably coupled to bottom flange 16 by spacer 182. Alternatively, lower flange 180 may be integrally formed with bottom flange 16 or back flange 14.

Because lower flange 180 is coupled to or integrally formed with bottom flange 16, bottom flange 16 supports lower flange 180 such that lower flange 180 hangs from bottom flange 16. Because lower flange 180 is supported by bottom flange 16, accessory 110 is a single piece structure which does not require any additional structures extending below lower flange 180. As a result, accessory 110 is well suited for use in structures where space below lower flange 180 is limited or in applications where the adjacent surface behind accessory 110 cannot accommodate additional structures which would otherwise be necessary to support lower flange 180. Consequently, accessory 110 is well suited for use adjacent to a foundation such as foundation 58 (shown in FIG. 2) or for use above a window or door casing such as casing 190 adjacent a window or door frame 191 (shown in FIG. 4).

Spacer 182 comprises an elongate strip and is positioned between bottom flange 16 and lower flange 180. Spacer 182 preferably has a thickness of about 40–70 thousands of an inch so as to space bottom flange 16 from lower flange 180 by at least a corresponding distance. Spacer 182 preferably has a width transversely extending from edge 28 towards edge 30 of bottom flange 16 such that spacer 182 terminates adjacent to perforations 34. Spacer 182 extends along the axial length of accessory 110 adjacent edge 28 of bottom flange 16. Spacer 182 preferably comprises an independent component fastened, preferably by welding, to both bottom flange 16 and lower flange 180. Alternatively, spacer 182 may be integrally formed as part of a single unitary body with either bottom flange 16 or lower flange 180. It has been discovered that because spacer 182 comprises a component distinct either from bottom flange 16 or lower flange 180, spacer 182 increases the rigidity and stiffness of bottom flange 16. Although less desirable, spacer 182 may alternatively be integrally formed with both flange 16 and lower flange 180.

Drip leg 184 comprises an elongate imperforate strip coupled to bottom flange 16 proximate to edge 30 of bottom flange 16. In the embodiment illustrated, drip leg 184 is coupled bottom flange 16 via lower flange 180 and spacer 182. Alternatively, drip leg 184 may be directly attached to or extruded with bottom flange 16. Drip leg 184 extends away from and beyond edge 30 of bottom flange 16 to direct moisture such as rain or snow away from an underlying structure such as a door or window casing. Because drip leg 184 preferably extends from lower flange 180 below perforations 34, leg 184 additionally directs moisture escaping from space 74 away from the underlying structure. Drip leg 184 extends nonparallel from lower flange 180 at a downward angle.

Filter material 186 extends adjacent and over array 132 of perforations 34. Filter material 186 is preferably located within cavity 188 between bottom flange 16 and lower flange 180. Filter material 186 permits the flow of moisture through filter material 186. At the same time, filter material 186 prevents larger aggregations of wind-blown moisture as well as flying insects from passing through filter 186 and through perforations 34. Although filter material 186 may comprise any one of a variety of known materials having such characteristics, filter material 186 preferably comprises an open celled vinyl coated mesh or screening. Because filter material 186 preferably comprises an open celled material or screening, filter material 186 further strengthens and rigidifies panel support construction accessory 110.

Construction accessory 110 is preferably extruded from a virgin vinyl compound. Accessory 110 is preferably extruded from a weatherable grade, lead-free polyvinylchloride. Construction accessory 110 alternatively may be formed from various other polymer or vinyl compounds, aluminum, galvanized steel or other metals. Moreover, in lieu of back flange 14, bottom flange 16, side flange 18, support flange 20 and front flange 22 being integrally formed as part of a single unitary body, components may alternately be formed using various distinct prefabricated components which are glued, welded or otherwise affixed to one another to form construction accessory 110.

As shown by FIG. 4, moisture accumulates within space 74 below construction panel 66 and above bottom flange 16. As shown by arrows 178, moisture accumulated within space 74 flows through perforations 34 and through filter material 186 between bottom flange 16 and lower flange 180. The moisture further flows across lower flange 184. As a result, construction accessory 110 facilitates the removal of undesirable moisture otherwise captured between moisture barrier 64 and coating 68 to prolong the life of structure 12.

Figure 7:
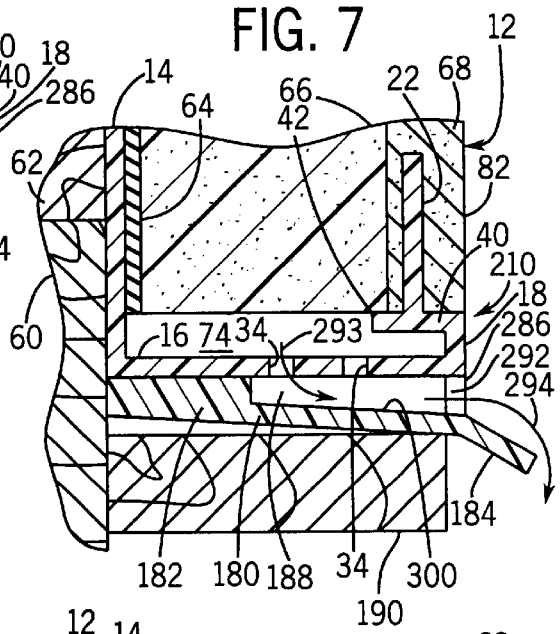
FIG. 7 is a sectional view of a structure incorporating the panel support construction accessory of FIG. 5.
Figure 6:
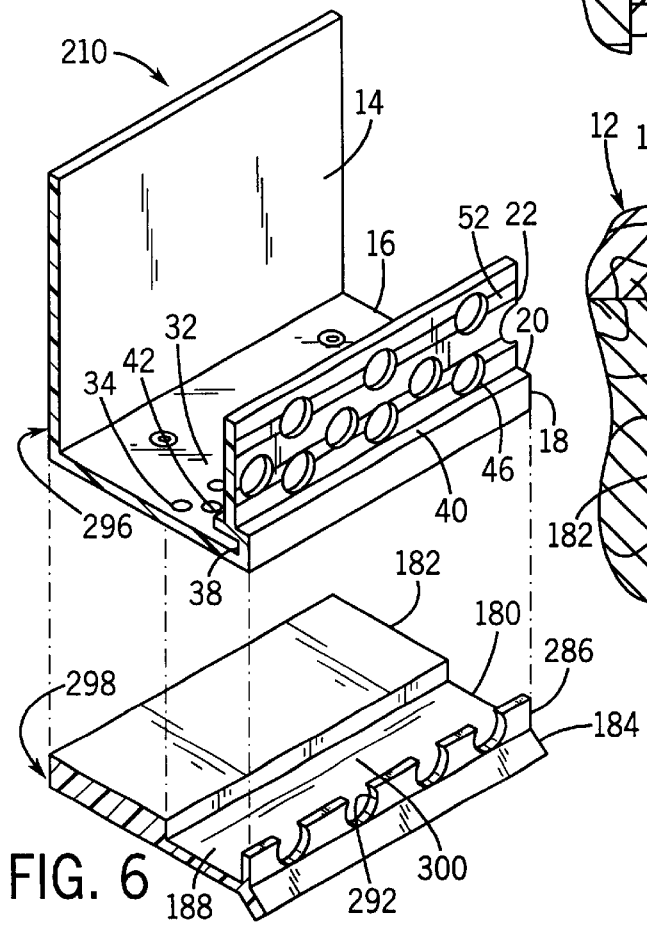
FIG. 6 is an exploded perspective view of the panel support construction accessory of FIG. 5.

FIGS. 5–7 illustrate construction accessory 210, a third embodiment of panel support construction accessory 10 shown in FIGS. 1 and 2. FIG. 5 is an assembled view of construction accessory 210. FIG. 6 is an exploded view of construction accessory 210. FIG. 7 is a sectional view of construction accessory 210 utilized in structure 12 including casing 190. As best shown by FIG. 5, construction accessory 210 is similar to construction accessory 110 except that construction accessory 210 includes forward flange 286 in lieu of filter material 186. Alternatively, construction accessory 210 may include forward flange 286 in addition to filter material 186. For ease of illustration, the remaining elements of construction accessory 210 which correspond to similar elements of construction accessory 110 are numbered similarly. Forward flange 286 extends between lower flange 180 and bottom flange 16 adjacent to cavity 188. Forward flange 286 extends opposite spacer 182 to enclose cavity 188. Forward flange 286 preferably includes a plurality of openings 292 that extend through forward flange 286 and communicate with cavity 188.

As best shown by FIG. 7, moisture accumulated within space 74 flows through perforations 34 into cavity 188 as indicated by arrow 293. Moisture within cavity 188 further flows across lower flange 180 through openings 292 where the moisture is directed away from window or door casing 190 by drip leg 184 as indicated by arrow 294. As a result, construction accessory 210 facilitates the removal of undesirable moisture otherwise captured between moisture barrier 64 and coating 68 to prolong the life of structure 12. At the same time, forward flange 286 further impedes wind-blown moisture and flying insects from entering space 74. Because openings 292 extend generally perpendicular to perforations 34, openings 292 and perforations 34 enable moisture to escape from space 74 while reducing, if not completely eliminating, the possibility of wind-blown moisture entering space 74. Although less desirable, openings 292 may alternatively extend through portions of lower flange 180 in lieu of or in addition to extending through forward flange 286 to communicate with cavity 188 depending upon the configuration of construction accessory 210 as well as the configuration of structure 12 and casing 190.

As further shown by FIG. 7, forward flange 286 preferably has a vertical height greater than the vertical height or thickness of spacer 182 such that surface 300 of lower flange 180, which extends adjacent to cavity 188 below perforations 34, downwardly slopes away from back flange 14 and bottom flange 16 towards forward flange 286. In the embodiment illustrated, spacer 182 has a height or thickness extending between lower flange 180 and bottom flange 16 of about 0.050 inches while forward flange 286 has a vertical height of about 0.075 inches. In the embodiment illustrated, forward flange 180 is manufactured such that surface 300 has a natural gradient. Alternatively, lower flange 180 may be formed from a deformable or flexible material such that the greater height of forward flange 286 as compared to the vertical height of spacer 182 causes surface 300 to deform or deflect sufficiently to cause surface 300 to have a downward slope. As shown by FIG. 7, the downwardly sloping surface 300 further facilities the flow of moisture through openings 292 and away from structure 12.

FIG. 6 best illustrates the preferred assembly of construction assembly of 210. As best shown by FIG. 6, construction accessory 210 is preferably constructed from a first panel support component 296 and a second add-on component 298. Component 296 includes back flange 14, bottom flange 16, side flange 18, support flange 20 and front flange 22. Component 298 includes lower flange 180, spacer 182, drip leg 184 and forward flange 286. Lower flange 180 of component 298 is configured for being coupled to component 296 so as to extend below bottom flange 16 and so as to provide surface 300 spaced from bottom flange 16 below perforations 34. In the embodiment illustrated, spacer 182 couples lower flange 180 to bottom flange 16 of component 296.

As shown by FIG. 5, components 296 and 298 are preferably coupled together by welding. In particular, spacer 182 of component 298 is positioned adjacent to the lower surface of bottom flange 16. Sufficiently heated pins are positioned adjacent a top surface of bottom flange 16 and are further downwardly actuated to pierce bottom flange 16 and partially extend into spacer 182. At the same time, the heated pins melt and fuse the materials of bottom flange 16 and spacer 182 together to securely couple component 296 to component 298. As can be appreciated, other fasteners or fastening methods using glue, adhesives, rivets, thermoplastics, thermosets, epoxies, mechanical interlocks and mechanical fasteners may be used to secure components 296 and 298 together. Of course, these alternative fasteners or fastening methods will vary depending upon the type of materials from which components 296 and 298 are formed as well as the particular configuration of components 296 and 298.

Components 296 and 298 are preferably manufactured from extruded polyvinylchloride. Other manufacturing techniques and materials may also be used. Perforations 34, perforations 46 and openings 292 are preferably formed using punching processes. As can be appreciated, the shape and size of perforations 34, perforations 46 and openings 292 may vary. Moreover, the manufacturing techniques used to form perforations 34, perforations 46 and openings 292 may also vary. As a result of this particular construction, component 298 may be easily and inexpensively manufactured. In addition, component 298 may be easily attached and added to existing panel support structures which have been modified to include perforations 34. Although component 298 is illustrated as including spacer 182 and forward flange 286, spacer 182 and forward flange 286 may alternatively be formed as part of component 296 such that spacer 182 and forward flange 286 extend from a lower surface of bottom flange 16.

Figure 8:
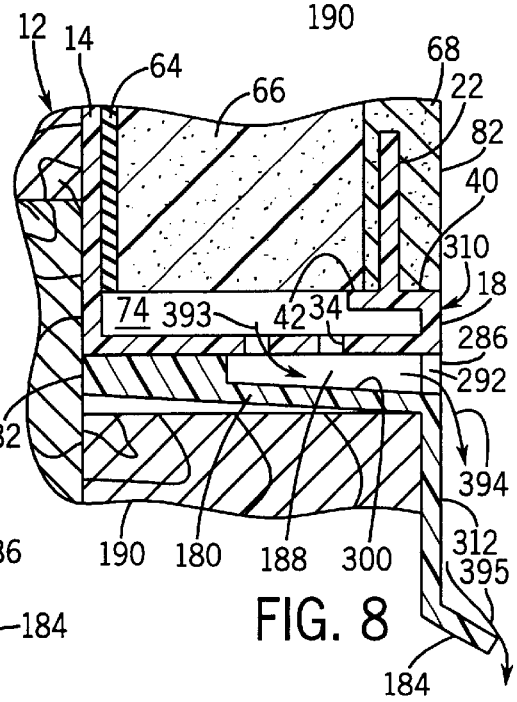
FIG. 8 is a sectional view of a structure incorporating a fourth embodiment of the panel support construction accessory of FIGS. 1 and 2.

FIG. 8 is a sectional view illustrating construction accessory 310, a fourth embodiment of construction accessory 10. Construction accessory 310 is identical to construction accessory 210 except that construction accessory 310 additionally includes side flange 312 extending nonparallel from lower flange 180 below openings 292. Side flange 312 supports drip leg 184 below and adjacent to casing 190. Side flange 312 is preferably integrally extruded as part of component 298. Alternatively, side flange 312 may be mounted or coupled to lower flange 180 by various fasteners or fastening methods. Side flange 312 covers and protects casing 190. As indicated by arrows 393, 394, and 395, moisture within spacer 74 is effectively discharged away from casing 190.

Figure 10:
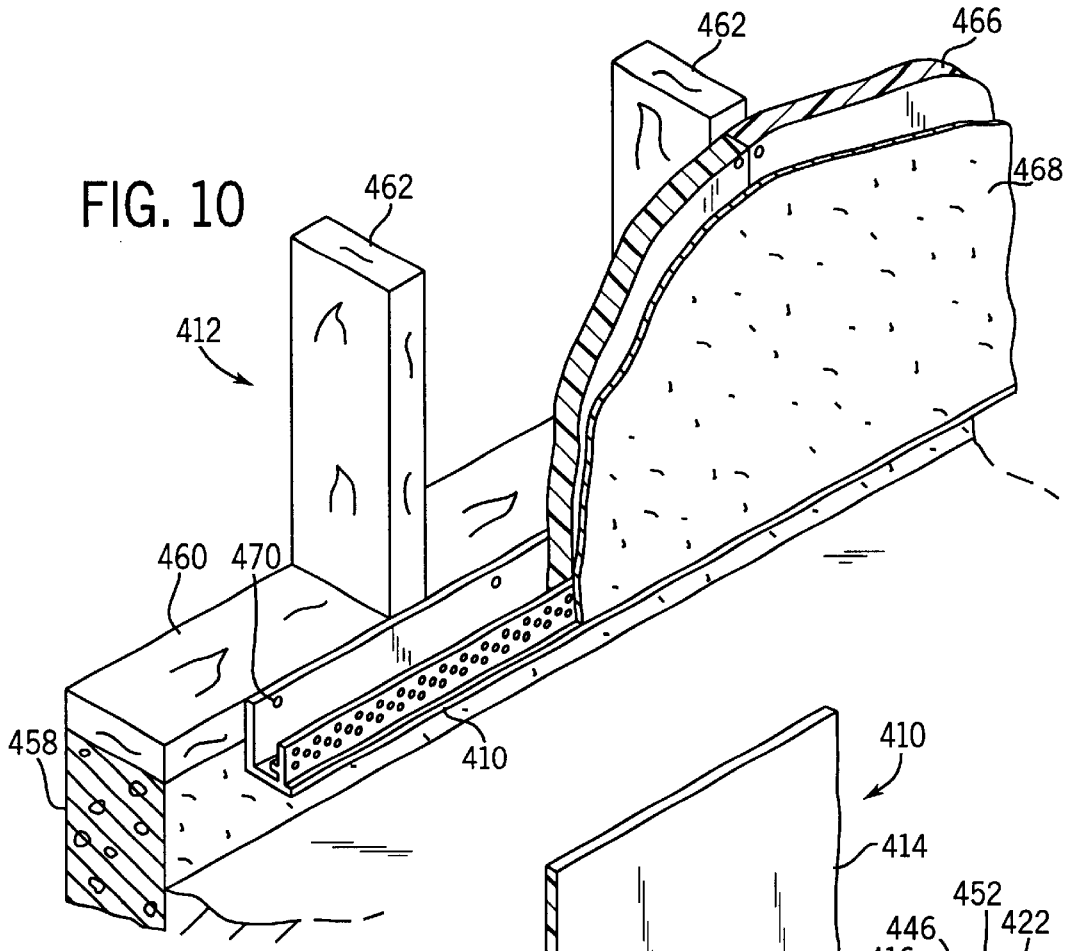
FIG. 10 is a sectional view of a structure incorporating the accessory of FIG. 9.
Figure 9:
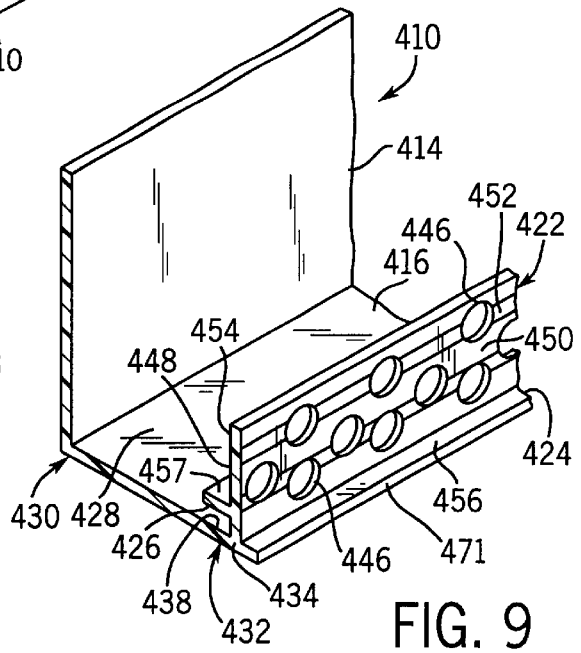
FIG. 9 is a fragmentary perspective view of a fifth alternative embodiment of the accessory of FIG. 1.
Figure 11:
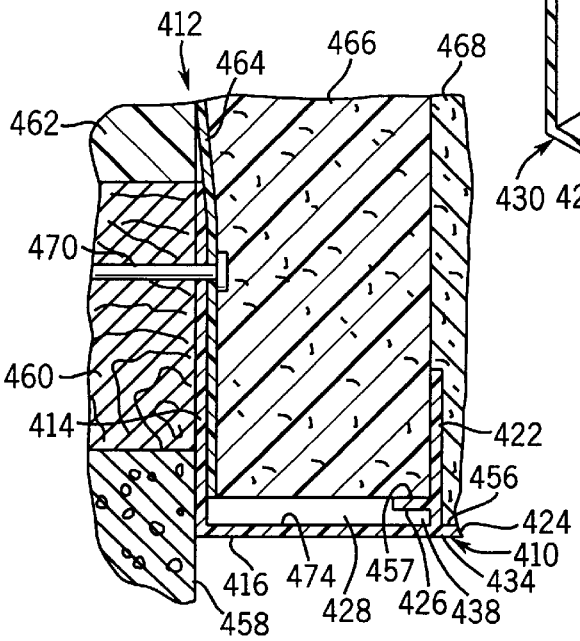
FIG. 11 is a fragmentary sectional view of the structure of FIG. 10.

FIGS. 9–11 illustrate panel support construction accessory 410, a fifth embodiment of construction accessory 10. FIGS. 9 and 10 illustrate a construction system or structure 412 employing construction accessory 410. As best shown by FIG. 9, construction accessory 410 generally includes back flange 414, bottom flange 416, front flange 422, forward flange 424, and rearward flange 426. Back flange 414, bottom flange 416 and front flange 422 extend nonparallel relative to one another to form an axially extending channel 428 sized to receive and support a construction panel adjacent structural members. In the exemplary embodiment, channel 428 has a width of about 1.5 inches. Back flange 414 is a generally elongate panel configured for being mounted adjacent to a structural support member of a structure.

Bottom flange 416 comprises an elongate panel coupled to back flange 14 and extending from back flange 414. Bottom flange 416 preferably extends perpendicular from back flange 414. Bottom flange 416 has a first end 430 coupled to back flange 414 and a second end 432 coupled to front flange 422 at junction 434.

Front flange 422 is adjoined to bottom flange 416 at junction 434 and extends nonparallel relative to bottom flange 416. Front flange 422 preferably perpendicularly extends from bottom flange 416 opposite to back flange 414 to form channel 428. Front flange 422 generally comprises an elongate panel including perforations or apertures 446 which extend between an inner surface 448 and an outer surface 450 of flange 422. Front flange 422 additionally includes depressions 452, 454. Depressions 452, 454 comprise elongate channels extending within outer surface 450 and inner surface 448, respectively, of front flange 22. Depressions 452, 454 extend along the axial length of front flange 422 and communicate between apertures 446 to increase the flow of construction fluid materials along front flange 422. Apertures 446 and depressions 452, 454 are described in greater detail in co-pending U.S. patent application Ser. No. 09/059,806 now U.S. Pat. No. 5,970,671 by Gabriel F. Bifano and Erenio Reyes, entitled CONSTRUCTION ACCESSORY, the full disclosure of which is hereby incorporated by reference.

Forward flange 424 comprises an elongate lip extending from junction 434 of bottom flange 416 and front flange 422. Forward flange 424 extends from junction 434 away from back flange 414. Forward flange 424 has an upper surface 456 which provides a shoulder or ledge which serves as a ground for construction fluid materials. Forward flange 424 also provides a smooth continuous corner which is resistant to chipping or other damage. In the exemplary embodiment shown, forward flange 424 extends from junction 434 parallel with bottom flange 416 and preferably coplanar with bottom flange 416. Forward flange 424 preferably extends perpendicular relative to front flange 422. Forward flange 424 preferably has a width of at least $1/16^{th}$ of an inch. Forward flange 424 preferably has a width of approximately $1/12^{th}$ of an inch.

Rearward flange 426 comprises an elongate lip extending from inner surface 448 of front flange 422 towards back flange 414 above bottom flange 416. In the exemplary embodiment, rearward flange 426 perpendicularly extends from a midpoint of front flange 422 such that the junction of rearward flange 426 and front flange 422 have a substantially T-shaped cross section. Rearward flange 426 extends above bottom flange 416 to form a channel 438 sized to receive a reinforcement member such as a splice (not shown) for connecting adjacent accessories 410. Rearward flange 426 further includes an upper surface 457 which provides a ridge sized to support a construction panel as shown in FIGS. 10 and 11.

As best shown by FIGS. 10 and 11, structure 412 includes construction accessory 410 and additionally includes foundation 458, structural support members 460, 462, moisture barrier 464, construction panel 466, coating 468, and fastener 470. Foundation 458 and structural support members 460 and 462 form a conventionally known framed structure arrangement wherein structural support member 460 comprises a base, wood or metal, two-by-four and structural support member 462 comprises a wood or metal stud two-by-four fastened to member 460. As shown by FIG. 11, accessory 410 is fastened to structural support member 460 by fastener 470. To prevent moisture from entering a building or other enclosure formed by structure 412, moisture barrier 464 is positioned within channel 428 over back flange 414 and adjacent structural support members 460 and 462. As will be appreciated, back flange 414 and accessory 410 may be affixed to either structural support member 460 or 462 by various other adhesives or fasteners. Moreover, back flange 414 may alternatively be affixed to an intermediate sheet or panel affixed to structural support members 460 and 462.

Construction panel 466 comprises a conventionally known construction panel positioned within channel 428. As shown by FIG. 11, the ridge provided by surface 457 of rearward flange 426 elevates construction panel 466 above bottom flange 416 to form a gap or space 474 between bottom flange 416 and construction panel 466. Space 474 provides an expansion cavity for accumulated moisture.

Coating 468 comprises a polymer based or polymer modified exterior construction fluid material. Coating 468 preferably comprises a cement matrix material. Alternatively, coating 468 may comprise stucco or gypsum matrix materials, including acrylic modifiers, or other known exterior coating materials. As best shown by FIG. 11, coating 468 extends above surface 456 of forward flange 424 adjacent to outer surface 450 of front flange 422 and adjacent to construction panel 466. Although not shown in detail, coating 468 also extends through apertures 446 into contact with portions of construction panel 466 adjacent inner surface 448 to bond between construction panel 466 and front flange 422. Coating 468 also flows within depressions 452 and 454. Although initially applied in a liquid or viscous state, coating 468 hardens to a solid state to cover and protect front flange 422 and construction panel 466 as well as to provide an attractive appearance.

Overall, panel support construction accessory 410 provides several additional benefits as compared to panel support construction accessory 10 shown in FIG. 1. Because forward flange 424 extends from junction 434 of bottom flange 416 and front flange 422, accessory 410 eliminates side flange 18 while still providing a ledge or shoulder above surface 456 for supporting and grounding coating 468 in front of front flange 422 and for regulating the thickness of coating 468 applied to front flange 422 and construction panel 466. By eliminating side flange 18, accessory 410 enables a greater portion of accessory 410 to be covered with coating 468. In particular, instead of having a side flange 18 exposed below support flange 20 and shoulder 40 which is different in texture, if not appearance, from the coating, accessory 410 merely exposes an edge 471 of forward flange 424. Since edge 471 is much smaller than side flange 18, the resulting structure 412 incorporating accessory 410 is more visually appealing. Moreover, accessory 410 is more easily manufactured using an extrusion process wherein back flange 414, bottom flange 416, front flange 422, forward flange 424, and rearward flange 426 are integrally formed as part of a single unitary body. As will be appreciated, each of back flange 414, bottom flange 416, front flange 422, forward flange 424 and back flange 426 may be independently formed and welded, bonded or otherwise affixed to each other to form accessory 410. Although less desirable, front flange 422 may have various other sizes, shapes and configurations. For example, front flange 422 may omit depressions 452, 454 or may omit apertures 446. Although less desirable, accessory 410 may also alternatively omit rearward flange 426 or may have axially spaced rearward flange sections. These and other variations are contemplated within the disclosure.

Figure 12:
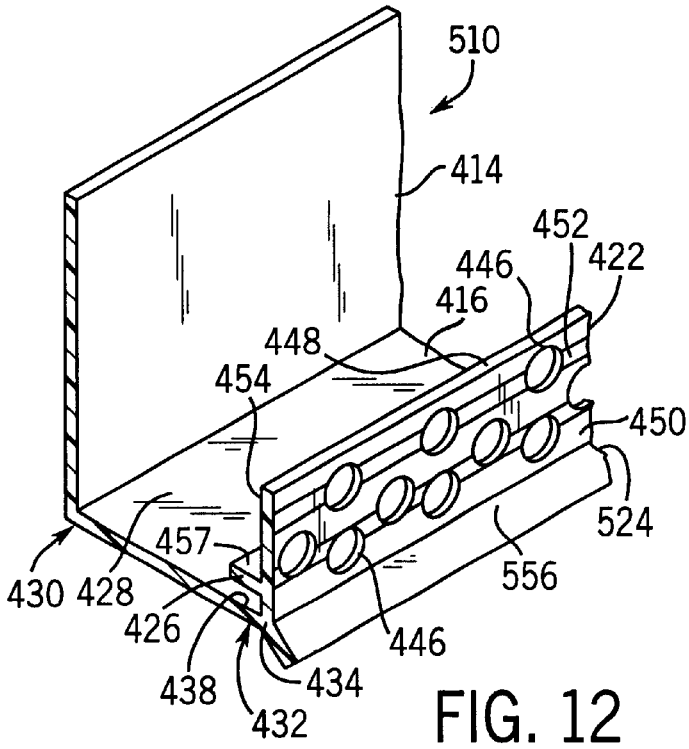
FIG. 12 is a fragmentary perspective view of a sixth alternative embodiment of the accessory of FIG. 1.
Figure 13:
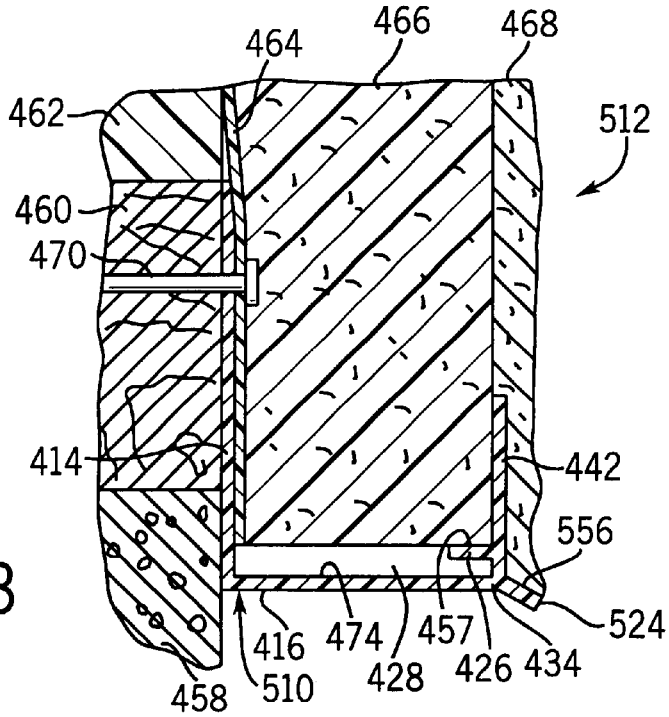
FIG. 13 is a sectional view of a structure incorporating the accessory of FIG. 12.

FIGS. 12 and 13 illustrate channel support construction accessory 510, a sixth embodiment of the construction accessory 10. FIG. 12 is a fragmentary perspective view of accessory 510. FIG. 13 is a sectional view of a structure 512 incorporating accessory 510. Structure 512 is substantially identical to structure 412 except that structure 512 includes accessory 510 in lieu of accessory 410. Construction accessory 510 is identical to construction accessory 410 except that accessory 510 includes forward flange 524 in lieu of forward flange 424. For ease of illustration, those remaining components of construction accessory 510 which correspond to components of construction accessory 410 are numbered similarly. As best shown by FIG. 12, forward flange 524 is similar to forward flange 424 except forward flange 524 angularly slopes from junction 434 away from back flange 414 below a lower surface of bottom flange 416. As a result, forward flange 524 has an upper surface 556 which provides a shoulder or ledge that extends forward and below bottom flange 416. As best shown by FIG. 13, because surface 556 of forward flange 524 extends below bottom flange 416, surface 556 supports and grounds coating 468 also below bottom flange 416 such that bottom flange 416 is concealed to a greater extent. As a result, structure 512 including accessory 510 provides a more pleasing frontal appearance.

Figure 14:
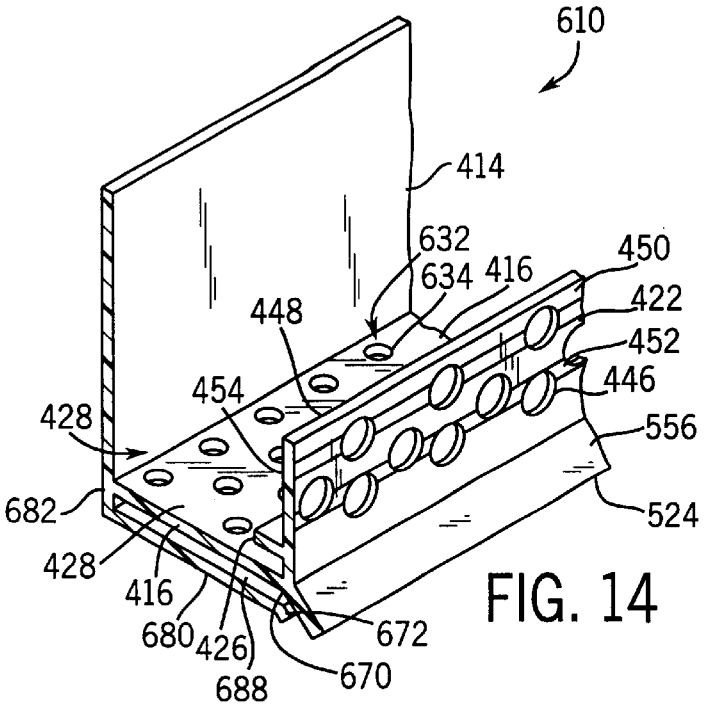
FIG. 14 is a fragmentary perspective view of a seventh alternative embodiment of the accessory of FIG. 1.
Figure 16:
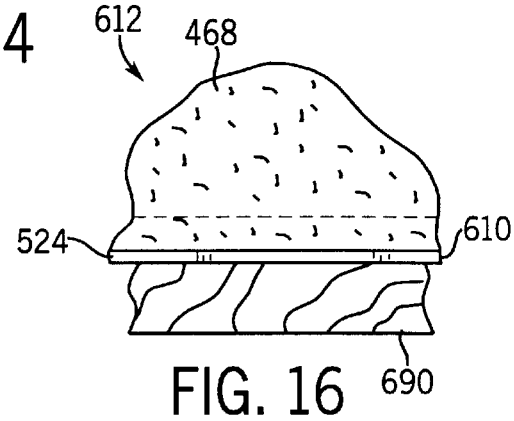
FIG. 16 is a front elevational view of the structure of FIG. 15 taken along lines 16—16.
Figure 15:
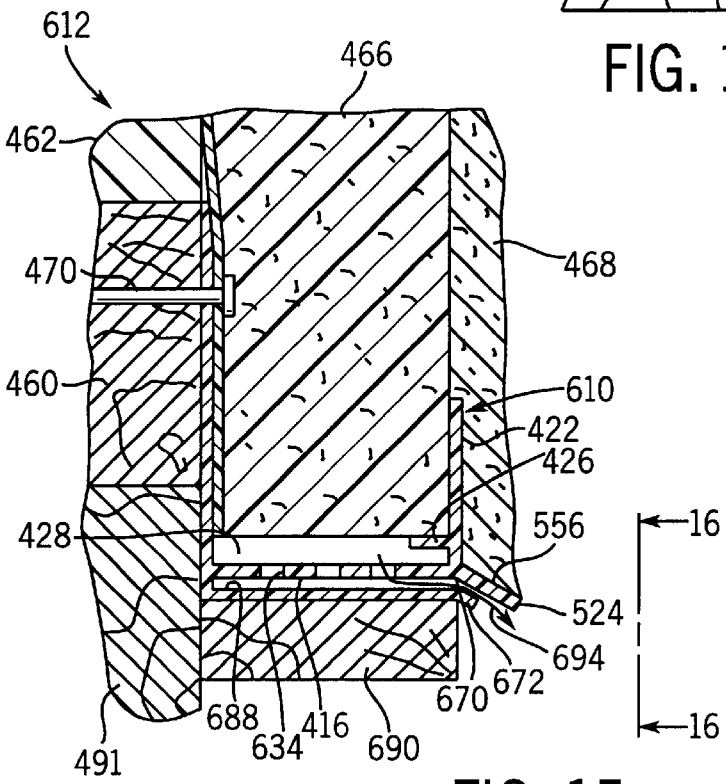
FIG. 15 is a sectional view of a structure incorporating the accessory of FIG. 14.

FIGS. 14–16 illustrate panel support construction accessory 610, a seventh alternative embodiment of accessory 10. FIG. 14 is a fragmentary perspective view of accessory 610. FIG. 15 is a sectional view of structure 612 incorporating accessory 610. FIG. 16 is a front elevational view of structure 612 taken along lines 16—16. Accessory 610 is similar to accessory 510 except that accessory 610 additionally includes an array 632 of perforations 634, lower flange 680, and lower extension 682. Array 634 generally includes a plurality of rows of perforations 632 extending between back flange 414 and front flange 422 along the longitudinal length of accessory 610. Each perforation 632 comprises an opening extending through bottom flange 416. Each perforation 634 preferably has a maximum diameter of approximately one-eighth of an inch. Perforations 634 enable moisture within channel 428 to escape. Because perforations 634 are arranged in an array, perforations 634 break the surface tension of accumulated water to prevent the water from clinging to the underside of bottom flange 416 such that the water more easily flows away from back flange 414 and structure 612 after having passed through perforations 634.

Lower flange 680 is a generally elongate imperforate panel coupled to bottom flange 416 and spaced from bottom flange 416 to form cavity 688 adjacent to and below array 632 of perforations 634. In the preferred embodiment illustrated, lower flange 680 is spaced from bottom flange 416 by approximately $1/32^{nd}$ to $1/4^{th}$ of an inch. In the embodiment illustrated, lower flange 680 is spaced from bottom flange 416 between about $1/16^{th}$ of an inch and about $3/32$ of an inch. Lower flange 680 prevents windblown moisture from entering channel 428 through perforations 634. Lower flange 680 also impedes flying insects from entering channel 428 through perforations 634. At the same time, lower flange 680 directs moisture expelled from channel 428 through perforations 634 outward through opening 670 formed by a gap between lower flange 680 and bottom flange 416. To further facilitate discharge of moisture outwardly away from structure 612, lower flange 680 additionally includes a downwardly sloped lip 672 adjacent opening 670. Although less desirable, lip 672 may be omitted.

Lower extension 682 extends from the junction of back flange 414 and bottom flange 416 to support lower flange 680 below bottom flange 416 and below perforations 634. In the exemplary embodiment, lower extension 682 is integrally molded as part of a single unitary body with back flange 414 and lower flange 680. Alternatively, lower extension 682 may be independently formed and welded, bonded or otherwise coupled to either or both of back flange 414 or lower flange 680. In addition, lower extension 682 may alternatively extend or hang from bottom flange 416. Although lower extension 682 is illustrated as extending generally parallel to bottom flange 416, lower extension 682 may alternatively be angled relative to bottom flange 416.

FIGS. 15 and 16 illustrate accessory 610 incorporated as part of structure 612. Structure 612 is similar to structure 412 except that structure 612 includes window or door casing 690 positioned below lower flange 680 and a window or door frame 691. For ease of illustration, those remaining components of structure 612 which correspond to similar components of structure 412 are numbered similarly. As best shown by FIG. 15, accessory 610 enables moisture accumulated within channel 428 to be expelled through perforations 634, through cavity 688 and out opening 670 as indicated by arrow 694. Lip 672 acts as a drip leg to further discharge moisture away from casing 690. At the same time, however, accessory 610 enables cavity 688 and opening 670 to be concealed during casual frontal inspection of structure 612. In particular, forward flange 524 is downwardly angled so as to extend below cavity 688. In the exemplary embodiment, forward flange 624 also preferably extends below lower flange 680, opening 670, and lip 672. As a result, forward flange 524 covers or blocks the view of cavity 688, lower flange 680, opening 670 and lip 672 when viewed at a height equal to forward flange 524 or from a height above the lower extremity of forward flange 524 to provide structure 612 with a more visually appealing appearance.

In the exemplary embodiment, surface 556 of forward flange 524 supports coating 468. Coating 468 preferably extends to the lower extremity of lower flange 524 so as to also extend below cavity 688 and preferably below lower flange 680, opening 670 and lip 672. As a result, as shown by FIG. 16, accessory 610 is substantially concealed and blocked or covered by coating 468.

Figure 17:
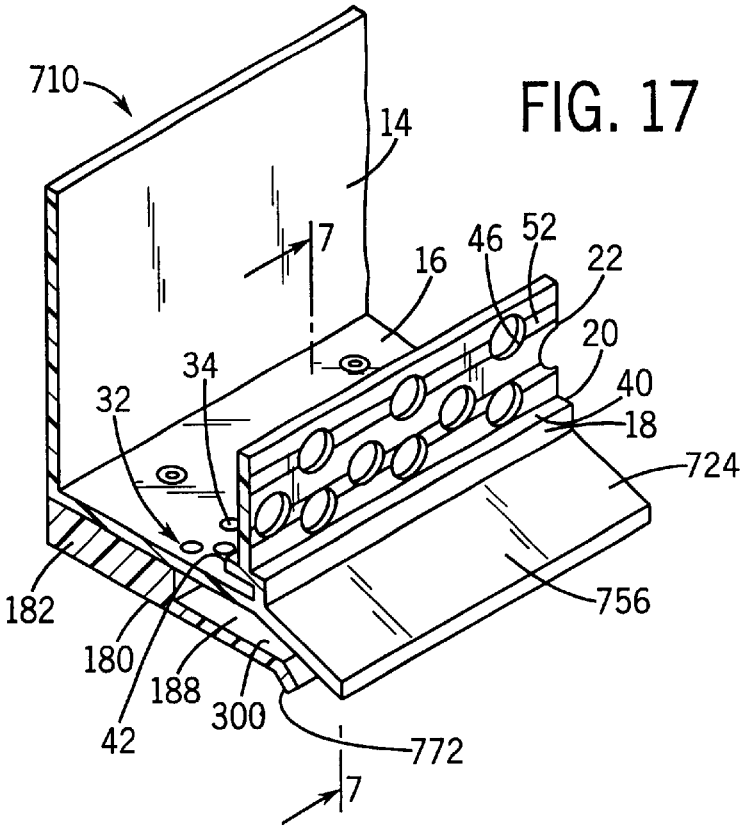
FIG. 17 is a fragmentary perspective view of an eighth alternative embodiment of the accessory of FIG. 1.
Figure 18:
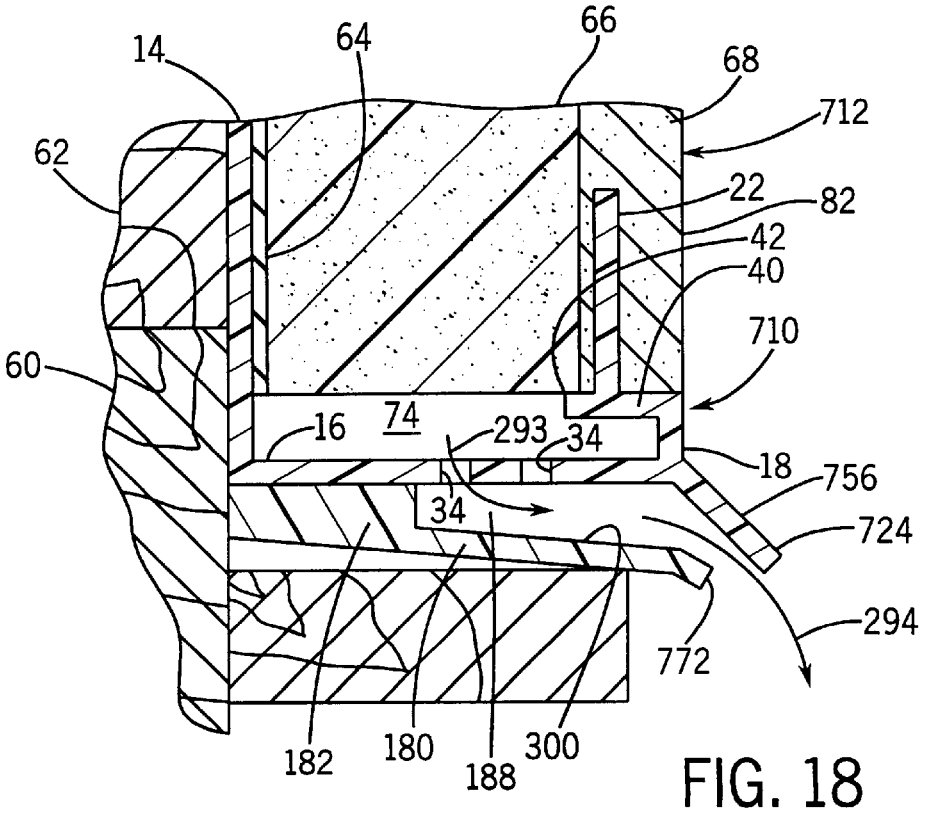
FIG. 18 is a sectional view of a structure incorporating the accessory of FIG. 17.

FIGS. 17 and 18 illustrate panel support construction accessory 710, an eighth alternative embodiment of accessory 10. FIG. 17 is a fragmentary perspective view of accessory 710. FIG. 18 is a sectional view of structure 712 incorporating accessory 710. Accessory 710 and structure 712 are substantially identical to accessory 210 and structure 12, respectively, shown in FIGS. 5 and 7 except that accessory 710 omits forward flange 286 and drip leg 184, and additionally includes forward flange 724 and drip leg 772. For ease of illustration, those remaining components of accessory 710 and structure 712 which correspond to similar components of accessory 210 and structure 12 are numbered similarly. Drip leg 772 is similar to drip leg 184 except that drip leg 772 is much shorter so as to facilitate its concealment by forward flange 724. Forward flange 724 extends from a juncture of bottom flange 16 and side flange 18 downwardly and forwardly away from back flange 14 to a location below cavity 188. In the exemplary embodiment, forward flange 724 preferably extends to a location below lower flange 180 and below drip leg 772. As a result, forward flange 724 conceals cavity 188 and preferably also conceals lower flange 180 and drip leg 772 to provide structure 712 with a more pleasing frontal appearance. Although less desirable, forward flange 724 may extend downwardly and rearwardly towards back flange 14 in alternative configurations where cavity 188 and casing 190 have a reduced width. In such an alternative configuration, forward flange 724 would still serve to conceal cavity 188.

Although coating 68 is illustrated as terminating at the front of side flange 18, structure 712 may be modified such that coating 68 further extends adjacent to surface 756 of forward flange 724 and such that coating 68 also extends below cavity 188 and below lower flange 180 and drip leg 772. Although forward flange 724 is illustrated as extending from the juncture of bottom flange 16 and side flange 18, forward flange 724 may alternatively extend only from bottom flange 16, only from side flange 18 or from front flange 22. In alternative configurations where accessory 710 includes alternative or additional flanges extending above cavity 188, forward flange 724 may alternatively extend from such alternative or additional flanges so long as forward flange 724 extends in a downward direction so as to at least partially conceal cavity 188 and preferably so as to entirely conceal cavity 188, lower flange 180 and drip leg 772 when structure 712 is viewed from its front side.

Each of panel support construction accessories 410, 510, 610 and 710 are preferably formed from extruded polyvinyl chloride. Each of the flanges and the drip legs of accessories 410, 510, 610 and 710 preferably have a thickness of approximately $1/16^{th}$ of an inch. Each of the panel support construction accessories 410, 510 and 610 are preferably extruded as a single integral unitary body. As will be appreciated, accessories 410, 510, 610 and 710 may be formed from a variety of alternative materials and may have a variety of alternative component thicknesses depending on the particular construction application. Moreover, in lieu of being integrally formed as part of a single unitary body, accessories 410, 510 and 610 may be formed from individual components secured or otherwise affixed to one another. Although each of accessories 410, 510, 610 and 710 have been illustrated as including a generally flat planar back flange 414, accessories 410, 510 and 610 may include alternative mounting structures including one or more variously configured mounting flanges depending upon the construction application and the type of support structure to which the accessory is mounted or supported. For example, in lieu of including a generally flat planar back flange 414 configured to be nailed or otherwise fastened along a front of a generally flat support structure, accessories 410, 510, 610 and 710 may include mounting flanges which project rearwardly and which are configured for being embedded within a support structure formed from such materials as concrete.

Although the present invention has been described with reference to preferred embodiments, workers skilled in the art will recognize that changes may be made in form and detail without departing from the spirit and scope of the invention. The present invention described with reference to the preferred embodiments and set forth in the following claims is manifestly intended to be as broad as possible. For example, unless specifically otherwise noted, the claims reciting a single particular element also encompass a plurality of such particular elements.

What is claimed is:

1. A construction system comprising:

at least one structural support member;

a panel support construction accessory including:

a front flange having a first side and a second opposite side;

a bottom flange extending from the front flange on the first side of the front flange;

a back flange extending from the bottom flange opposite the front flange, wherein the front flange, the bottom flange and the back flange form a channel, the back flange supported by the at least one structural support member; and a forward flange extending from a junction of the front flange and the bottom flange on the second side of the front flange, wherein the forward flange extends in a direction non-parallel relative to the front flange;

a construction panel positioned within the channel; and a coating extending from the forward flange adjacent to the second side of the front flange and adjacent to the construction panel.

2. The system of claim 1 wherein the panel support construction assembly includes a rear flange extending from the front flange towards the back flange above the bottom flange.

3. The system of claim 2 wherein the rear flange supports the construction panel above the bottom flange.

4. The system of claim 1 wherein the forward flange is sloped forwardly and downwardly from the bottom flange.

5. The system of claim 1 including a plurality of apertures extending through the front flange between the first side and the second side, wherein the coating extends through the apertures.

6. The system of claim 1 including:

a plurality of perforations extending through the bottom flange; and a lower flange facing the bottom flange and spaced from the bottom flange to form a cavity below the plurality of perforations and in communication with the plurality of perforations.

7. The system of claim 6 wherein the lower flange extends parallel to the bottom flange.

8. The system of claim 6 wherein the forward flange extends below the lower flange to conceal the cavity.

9. The system of claim 6 wherein the coating extends below the cavity.

10. The system of claim 1 wherein the coating is selected from a group of materials including: stucco, cement matrix material, gypsum matrix material, and gypsum matrix materials including acrylic modifiers.

11. The system of claim 1 wherein the structural support member comprises a framework of studs, wherein the back flange is fastened against the framework of studs.

12. A panel support construction accessory comprising:

a front flange having a first side and a second opposite side;

a bottom flange extending from the front flange on the first side of the front flange;

a back flange extending from the bottom flange opposite the front flange, wherein the front flange, the bottom flange, and the back flange form a channel sized to receive a construction panel;

a plurality of perforations extending through the bottom flange;

a lower flange coupled to the back flange and facing the bottom flange and spaced from the bottom flange to form a cavity below the plurality of perforations in communication with the plurality of perforations; and a forward flange extending from above the cavity to below the cavity in front of the cavity to at least partially conceal the cavity.

13. The construction accessory of claim 12 including a rear flange extending from the front flange towards the back flange above the bottom flange.

14. The accessory of claim 12 including a plurality of apertures extending through the front flange.

15. The accessory of claim 12 wherein the lower flange extends parallel to the bottom flange.

16. The accessory of claim 12 wherein the forward flange extends nonparallel to the bottom flange.

17. The accessory of claim 12 wherein the plurality of perforations are formed in a plurality of rows between the front flange and the back flange.

18. The accessory of claim 12 wherein the bottom flange has a width extending perpendicularly between the back flange and the front flange and wherein the cavity extends below the entire width of the bottom flange.

19. The accessory of claim 12 wherein the cavity has a height between about $1/16^{th}$ of an inch and about $3/32^{nd}$ of an inch.

20. The accessory of claim 12 wherein the forward flange extends from a junction of the front flange and the bottom flange.

21. The accessory of claim 12 wherein the forward flange extends from one of the bottom flange and the front flange.

22. The accessory of claim 12 wherein the forward flange extends downwardly in a forward direction away from the back flange.

23. A panel support construction accessory comprising:

a front flange having a first side and a second opposite side;

a bottom flange extending from the front flange on the first side of the front flange;

a back flange extending from the bottom flange opposite the front flange, wherein the front flange, the bottom flange and the back flange form a channel sized to receive a construction panel;

a forward flange extending from a junction of the front flange and the bottom flange on the second side of the front flange, wherein the forward flange extends in a direction non-parallel relative to the front flange; and a rear flange extending from the front flange towards the back flange above the bottom flange.

24. The accessory of claim 23 wherein the forward flange slopes forwardly and downwardly from the bottom flange.

25. The accessory of claim 23 including a plurality of apertures extending through the front flange.

26. The accessory of claim 23 including:

a plurality of perforations extending through the bottom flange; and a lower flange facing the bottom flange and spaced from the bottom flange to form a cavity below the plurality of perforations.

27. The accessory of claim 26 wherein the forward flange extends below the lower flange to conceal the cavity.

28. A panel support construction accessory comprising:

a bottom flange having a first side, a second side and a plurality of perforations extending therethrough from the first side to the second side;

a lower flange coupled to the bottom flange and extending below the bottom flange, wherein at least a portion of the lower flange is spaced from the bottom flange to form a cavity therebetween in communication with the plurality of perforations;

at least one mounting flange coupled to at least one of the bottom flange and the lower flange and configured to mount the panel support construction accessory to a structure;

at least one channel forming flange extending above the bottom flange opposite the at least one mounting flange; and at least one concealment flange extending from above the cavity to below the cavity in front of the cavity to at least partially conceal the cavity.

29. A panel support construction accessory comprising:

a bottom flange having a first side, a second side and a plurality of perforations extending therethrough from the first side to the second side;

a back flange extending from the bottom flange on the first side of the bottom flange;

a front flange extending from the bottom flange on the first side of the bottom flange, wherein the front flange extends in a single plane; and a rear flange extending from the front flange towards the back flange, wherein the rear flange is spaced from the bottom flange on the first side of the bottom flange and wherein the front flange extends above the rear flange, whereby the front flange and the back flange are adapted to receive at least one construction panel therebetween.

30. The system of claim 6, wherein the lower flange is coupled to the back flange.

31. The system of claim 30, wherein the lower flange is integrally formed as part of the single unitary body with the back flange.

32. The system of claim 30, wherein the lower flange is connected to the back flange.

33. The accessory of claim 12 when the lower flange is integrally formed as part of a single unitary body with the back flange.

34. The system of claim 12, wherein the lower flange is connected to the back flange.

35. The system of claim 26, wherein the lower flange is coupled to the back flange.

36. The system of claim 35, wherein the lower flange is integrally formed as part of the single unitary body with the back flange.

37. The system of claim 35, wherein the lower flange is connected to the back flange.

38. The accessory of claim 28 when the lower flange is integrally formed as part of a single unitary body with the back flange.

39. The system of claim 28, wherein the lower flange is connected to the back flange.

40. The system of claim 29, wherein the lower flange is coupled to the back flange.

41. The system of claim 40, wherein the lower flange is integrally formed as part of the single unitary body with the back flange.

42. The system of claim 40, wherein the lower flange is connected to the back flange.

43. A construction system comprising:

a construction accessory including:

a first flange having a first plurality of perforations therethrough;

a second flange;

a third flange extending between the first flange and the second flange, wherein the first flange, the second flange form a channel and wherein the third flange includes a second plurality of perforations extending through the third flange; and a fourth flange coupled to and facing the third flange, wherein at least a portion of the fourth flange is spaced from the third flange to form a cavity between the third flange and the fourth flange adjacent the second plurality of perforations;

a construction panel at least partially disposed within the channel between the first flange and the second flange; and a coating adjacent the first flange and extending through the first plurality of perforations.

44. The system of claim 43, wherein the fourth flange is supported by at least one of the first flange, the second flange and the third flange.

45. The system of claim 43, wherein the first flange, the second flange and the third flange are coupled to one another and wherein the fourth flange is integrally formed as part of a single unitary body with at least one of the first flange, the second flange and the third flange.

46. The system of claim 45, wherein the first flange, the second flange, the third flange and the fourth flange are integrally formed as part of a single unitary body.

47. The system of claim 45, wherein the fourth flange is connected to at least one of the first flange, the second flange and the third flange.

* * * * *